US007258548B2

(12) United States Patent
Lo

(10) Patent No.: US 7,258,548 B2
(45) Date of Patent: Aug. 21, 2007

(54) PORTABLE ELECTRONIC DEVICE AND EXTERNAL MODULE THEREOF

(75) Inventor: Chih-Kang Lo, Keelung (TW)

(73) Assignee: Benq Corporation, Taoyuan (TW)

( * ) Notice: Subject to any disclaimer, the term of this patent is extended or adjusted under 35 U.S.C. 154(b) by 104 days.

(21) Appl. No.: 10/944,203

(22) Filed: Sep. 17, 2004

(65) Prior Publication Data

US 2005/0059283 A1 Mar. 17, 2005

(30) Foreign Application Priority Data

Sep. 17, 2003 (TW) ..... 92125582 A

(51) Int. Cl.
*H01R 39/00* (2006.01)

(52) U.S. Cl. ..... 439/11; 439/31; 439/165; 439/13

(58) Field of Classification Search ..... 439/11, 439/31, 165; 361/683, 686
See application file for complete search history.

(56) References Cited

U.S. PATENT DOCUMENTS 5,677,827 A * 10/1997 Yoshioka et al. ..... 361/683
6,093,038 A * 7/2000 Chen et al. ..... 439/131
6,233,141 B1 * 5/2001 Lee et al. ..... 361/683
6,724,615 B2 * 4/2004 Kambayashi et al. ..... 361/683

* cited by examiner

*Primary Examiner*—X. Chung-Trans
(74) *Attorney, Agent, or Firm*—Thomas, Kayden, Horstemeyer & Risley

(57) ABSTRACT

A portable electronic device and an external module thereof. The portable electronic device comprises a host and an external module detachably connected thereto. The external module comprises a connector assembly and a connection pin rotatable on the same axis, such that the external module can hinge rotated between a horizontal position and a downward position with respect to the notebook computer, enabling access to the connectors on the portable electronic device.

18 Claims, 7 Drawing Sheets

PORTABLE ELECTRONIC DEVICE AND EXTERNAL MODULE THEREOF

BACKGROUND OF THE INVENTION

1. Field of the Invention

The present invention relates to an external module, and in particular to a rotatable external module for a portable electronic device.

2. Description of the Related Art

FIG. 1 shows a conventional notebook computer and an external module thereof. In FIG. 1, the external module 12 comprises a main body 121 with a connector 122 and two lugs 123. The host 111 of the notebook computer 11 has a port 112 receiving the connector 122 and fixing holes 113 receiving the lugs 123, fixing the external module 12 thereby.

Presently, notebook computers utilize different connectors for different peripheral devices. After attachment as shown in FIG. 2, however, the conventional external module 12 obstructs access to connectors 112, thus limiting expansion of peripheral devices.

SUMMARY OF THE INVENTION

Accordingly, an object of the invention is to provide a notebook computer and a rotatable external module, enabling access to connectors on the device.

The prevent invention provides a portable electronic device and an external module thereof. The portable electronic device comprises a host with a port and a fixing member. The external module comprises a connector assembly and a connection pin, both rotatable on the same axis. The external module detachably connects to the host via the connector assembly connected to the port and the connection pin engaged by the fixing member.

Because the connector assembly and connection pin are rotatable on the same axis, the external module, when connected to the host, can hinge to expose the side surface thereof and connectors thereon.

BRIEF DESCRIPTION OF THE DRAWINGS

The present invention can be more fully understood by reading the subsequent detailed description and examples with references made to the accompanying drawings which are given by way of illustration only, and thus are not limitation of the present invention, and wherein.

DETAILED DESCRIPTION OF THE INVENTION

Figure 1:
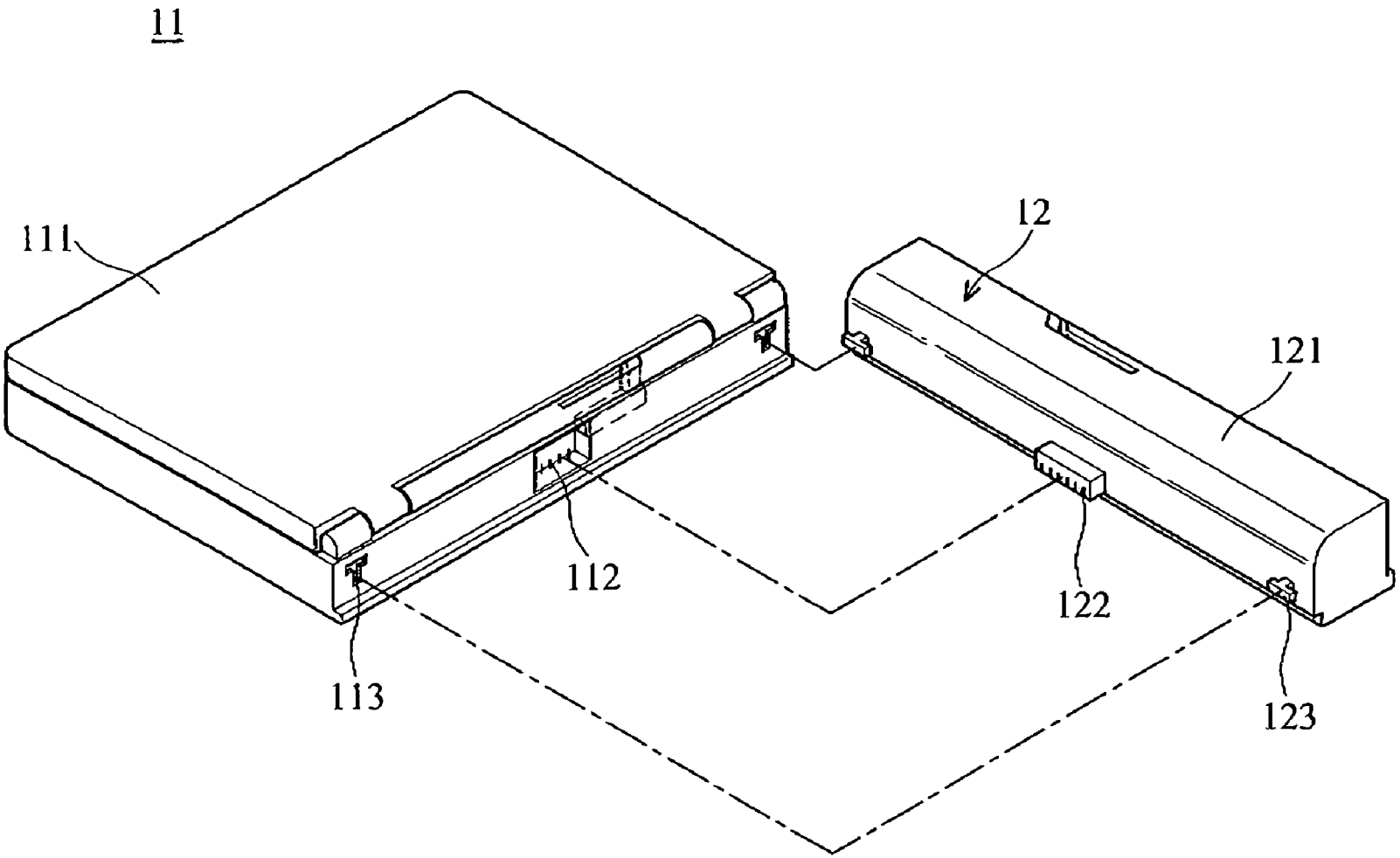
FIG. 1 (RELATED ART)
FIG. 1 is an exploded view of a conventional notebook computer and an external module thereof.
Figure 2:
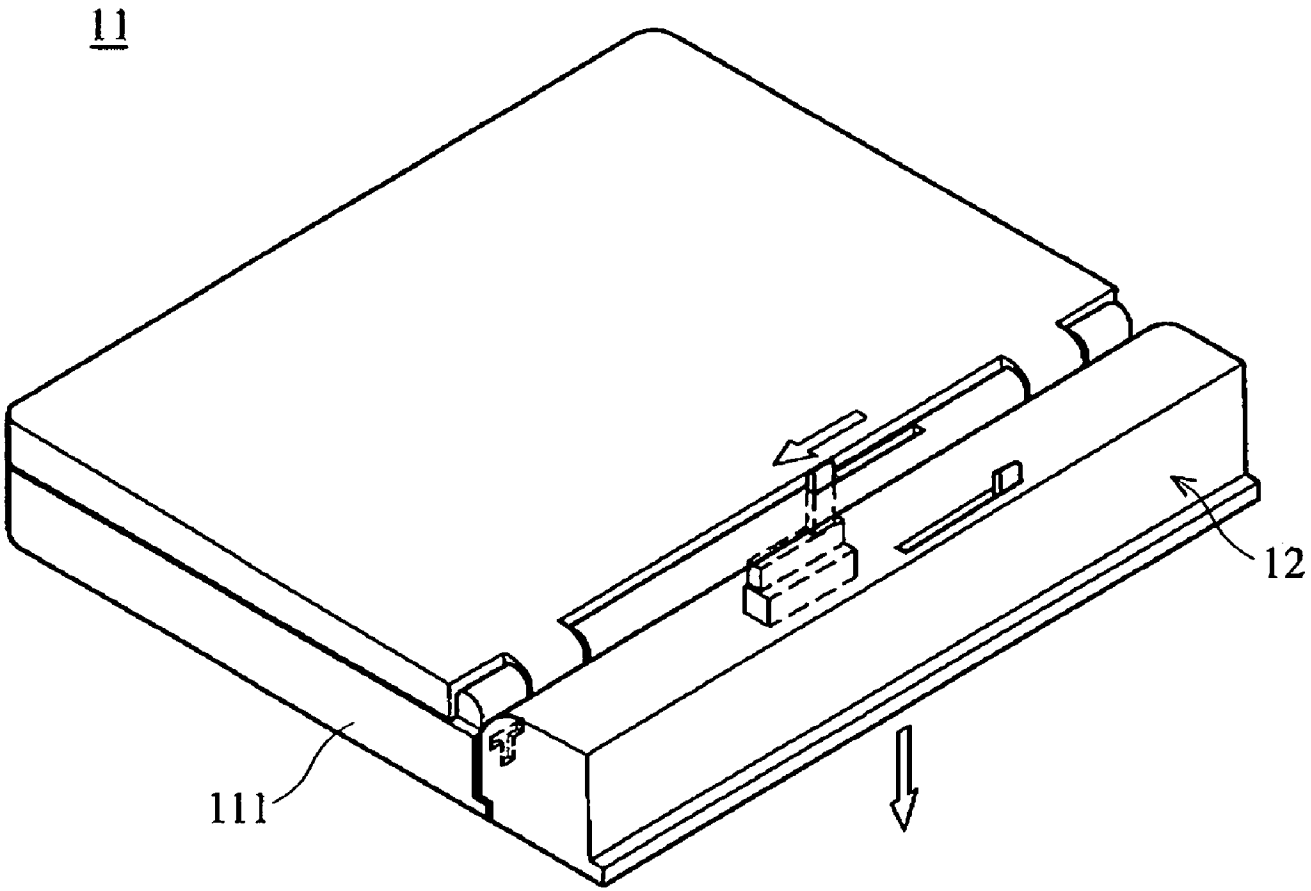
FIG. 2 (RELATED ART)
FIG. 2 shows the conventional external module connected to the notebook computer.
Figure 3:
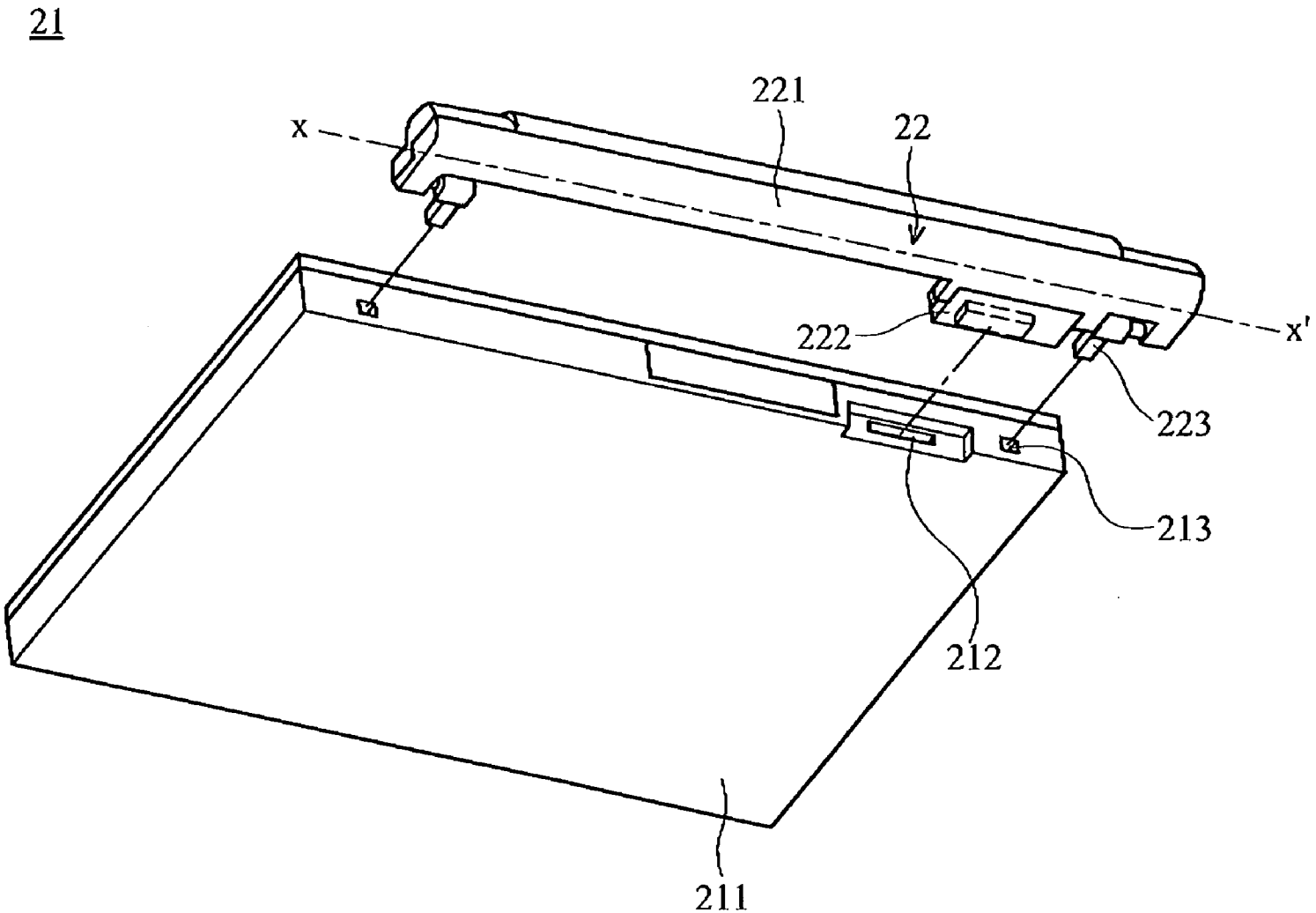
FIG. 3 is an exploded view of a notebook computer and an external module of the present invention.
Figure 4:
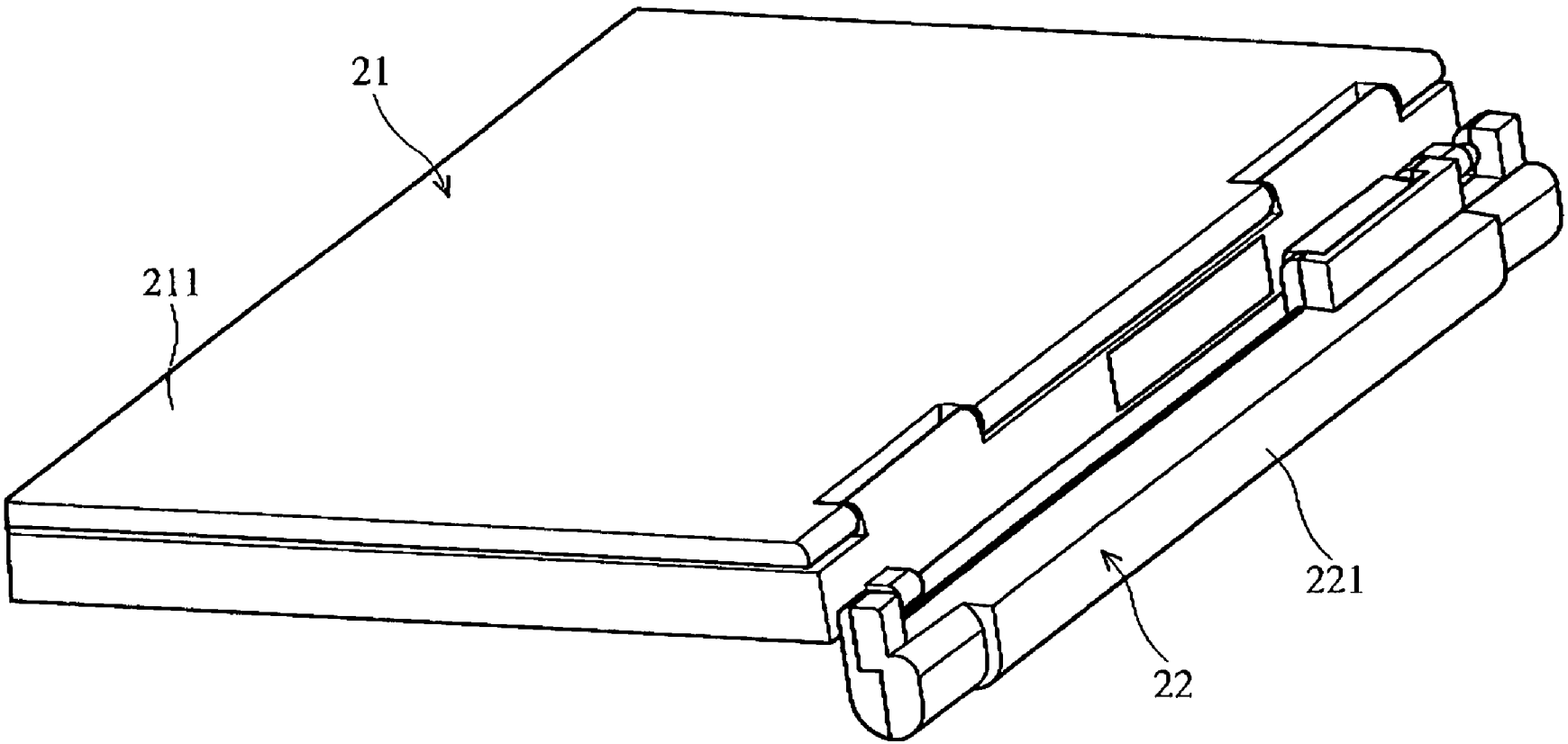
FIG. 4 shows the external module installed on the notebook computer and hinged downward.

FIG. 3 shows a conventional notebook computer and an external module of the present invention. In FIG. 3, the notebook computer 21 comprises a host 211 with a port 212 and two fixing members 213, or two holes with fixing means therein on each side of its rear surface. The external module 22 comprises a main body 221, a connector assembly 222, and two connection pins 223. The external module 22 can be detachably connected to the host 211 with the connector assembly 222 electrically connecting to the port 212 and the connection pins 213 inserted into the hole 213 and firmly engaged therein. The external module 22 also can be rotated on a first axis XX' with respect to the host 211 of the notebook computer 21, such that the external module 22 hinges to a downward position as shown in FIG. 4 after connecting to the host 211, avoiding obstruction to the connectors.

Figure 5:
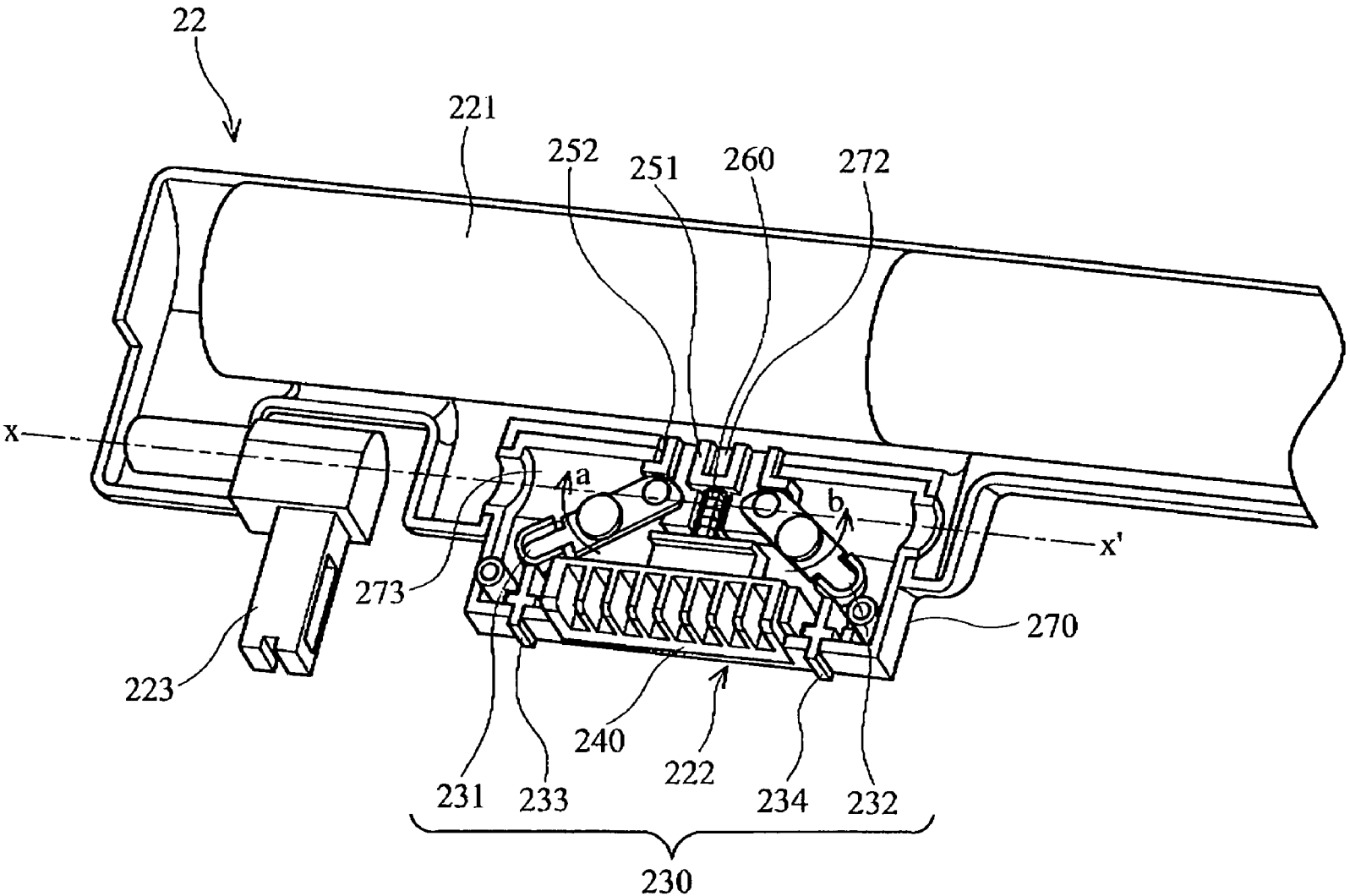
FIG. 5 is a partial schematic view of the inner structure of the external module.

FIG. 5 shows the inner structure of the external module 22. The external module comprises a main body 221, a connector assembly 222 and a connection pins 223 pivot on the main body 221. The connector assembly 222 and the connector pins 223 can rotate about the first axis XX', so that the connector assembly 222 can be selectively at a first angle or a second angle with respect to the main body 221. The main body 221 of the external module 22 comprises a first opening 252. The connector assembly 222 comprises a connector housing 270 with a through hole 272 and is rotatably connected to the main body 221. The connector housing 270 has a hollow portion 273 with a latch 251, a connector 240, and a link mechanism 230 therein. More, a spring 260 is disposed between the latch 251 and the connector 240.

The connector assembly 222 further comprises at least one sliding rod; in this embodiment, there are two sliding rods 233, 234. The connector 240 corresponds to the port 212 on the notebook computer 21. The link mechanism 230 comprises at least one linkage; in this embodiment there are two linkages 231, 232 pivoting on the connector housing 270 and arranged in a form of V as shown in FIG. 5. Each linkage 231, 232 is connected to the latch 251 at one end, and contacts one of the sliding rods 233, 234 at the other end. The sliding rods 233, 234 are movably disposed in the hollow portion 273 on each side of the connector 240.

When the external module is not connected to the notebook computer, the latch 251 passes through the through hole 272 and first opening 252, engaging with the main body 221. In this situation, the latch 251 maintains the connector assembly 222 at a first angle and fixes with the external module 22. The spring 260 exerts a spring force to fix the latch 251 and thus the linkages 231, 232 are immovable, so that the sliding rods keep protruding out the external module 22.

Figure 6:
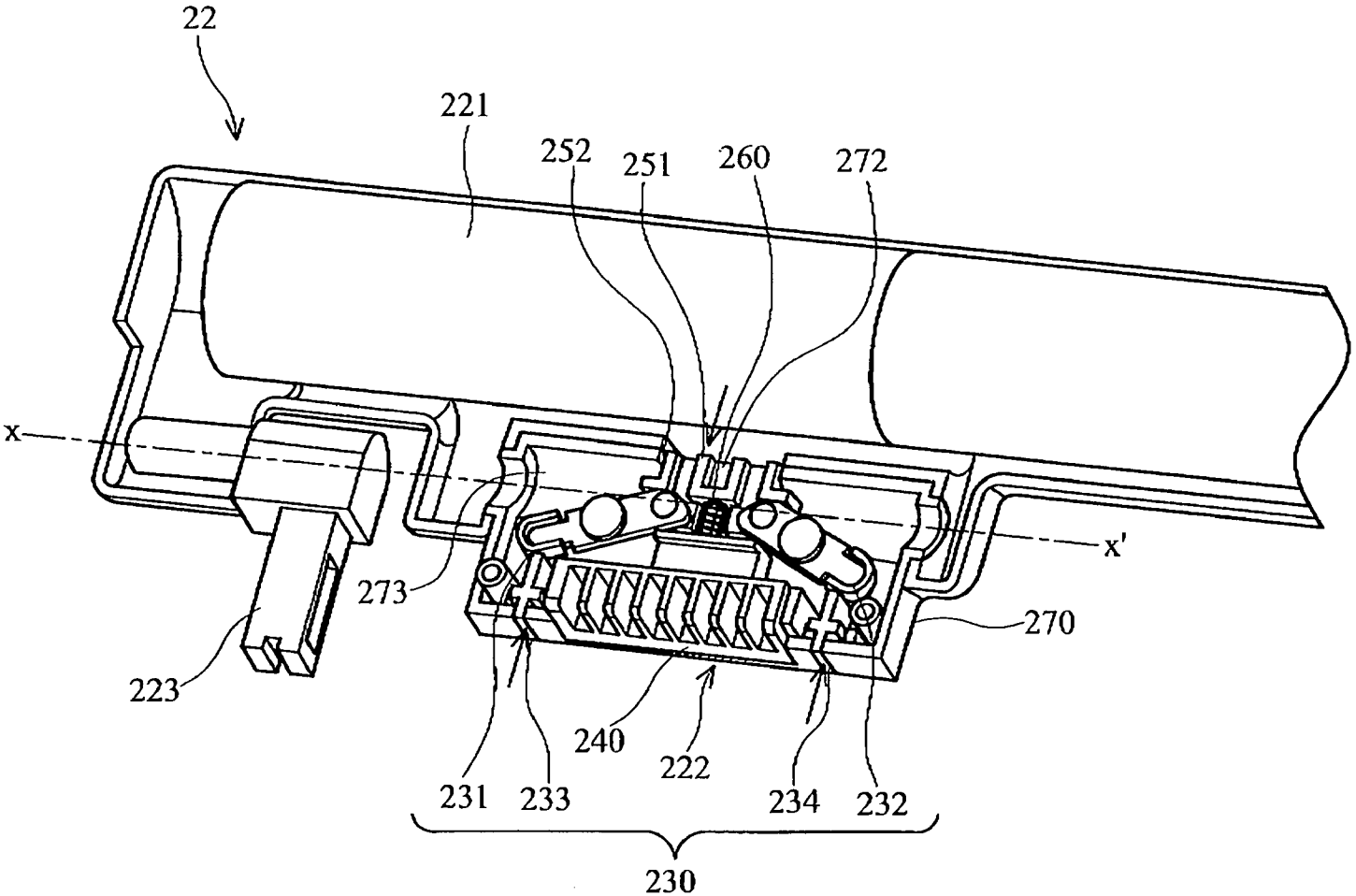
FIG. 6 shows the inner structure of the external module with the latch released from the opening thereof.

FIG. 6 shows the inner structure of the external module 22 when the external module 22 connects to a notebook computer. In order to simplify the drawing, the notebook computer is omitted.

When the external module 22 connects to a notebook computer, the connection pins 223 insert into the fixing members 213 and the connector 240 is connected to the port 212 of the notebook computer. The sliding rods 233, 234 are pushed by the host 211 and then move inward to the connector housing 270. Then, the linkages 231, 232 are pushed by the sliding rods 233, 234 to rotate in directions a and b shown in FIG. 5. Simultaneously, the latch 251 is pulled inward and received in the connector housing 270, separated from the first opening 252 of the main body 221. As a result, distance between the latch 251 and the connector 240 is shortened; the spring 260 is compressed to maintain the latch 251 in the connector housing 270. Thus, in this situation, the main body 221 of the external module 22 and the connection pins 223 can be rotated on the axis XX' with respect to the notebook computer 21.

Figure 7:
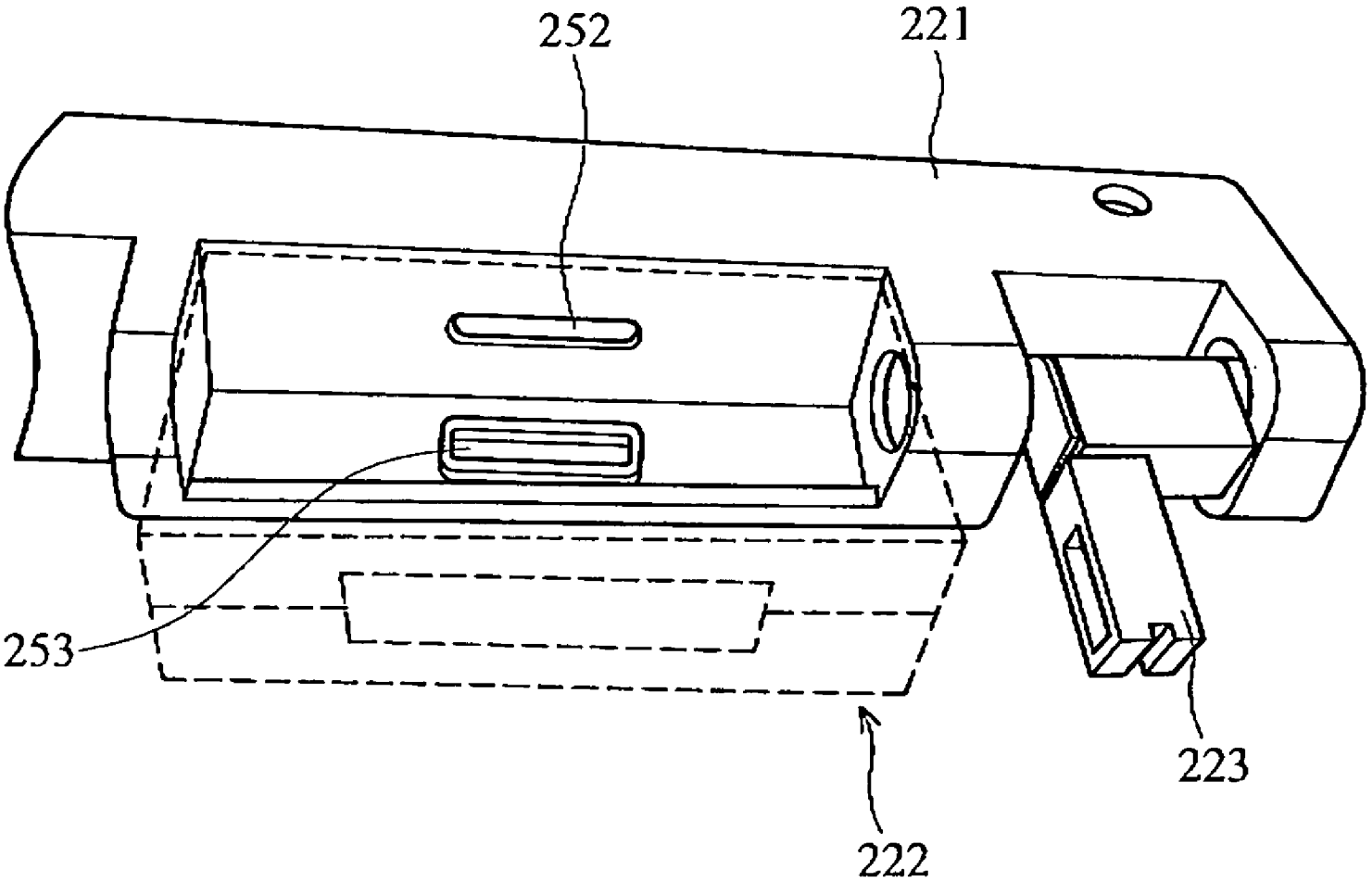
FIG. 7 is a schematic view of the external module showing the first and second openings thereon.

FIG. 7 shows the positions of the first and second openings 252, 253 on the external module 22. The connector assembly 222 is represented by a dashed line. In FIG. 7, the main body 221 of the external module 22 has a second opening 253 on a surface perpendicular to that of the first opening 252. The main body 221 of the external module 22 can rotate to the second angle such as downward position as shown in FIG. 4 when the external module 22 connects to the host 211 of the notebook computer 21. The connector assembly 222 and connection pins 223 are perpendicular to the main body 221 of the external module 22. At the same time, if the user separates the external module 22 from the host 211, the sliding rods again protrude out the connector assembly 222, so that the latch 251 is pushed by the spring 260 and protrudes into the second opening 253, maintaining the external module 22 at the second angle.

The external module 22 of the present invention can hinge between a horizontal position (0°) and a downward position (90°) with respect to the notebook computer 21 when the external module 22 connects to the notebook computer.

Furthermore, the spring 260 in the above embodiment can be disposed between the latch 251 and the connector 240, but is not limited thereto. One end of the spring 260 can be connected between the latch 251 and the connector 240, and the other end of the spring 260 can be connected to the linkages 231, 232, the sliding rods 233, 234, or the latch 251, the main purpose of the spring 260 is providing an elastic force to return the latch 251 and the sliding rods 233, 234 to their original positions.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An external module for connecting a host, the external module comprising:

a main body comprising a first opening;

a connector assembly selectively connected to the main body, wherein the main body is relatively rotatable to the connector assembly, comprising a latch, wherein the first opening provides the latch to protrude therein when the connector assembly is rotated to a first angle with respect to the main body; and a connection pin, pivoted on the main body.

2. The external module as claimed in claim 1, wherein the connector assembly comprises:

a connector housing rotatably connected to the main body on the first axis, comprising a hollow portion with the latch therein and an opening through which the latch passes; and a sliding rod movably disposed in the hollow portion.

3. The external module as claimed in claim 2, wherein the connector assembly further comprises a link mechanism connected to the latch and the sliding rod, when the main body being connected to the host, the sliding rod being pushed inward into the connector housing, so that the latch releasing from the first opening by movement of the link mechanism.

4. The external module as claimed in claim 3, wherein the link mechanism comprises:

a first linkage disposed in the hollow portion and pivoted to the latch at one end; and a second linkage disposed in the hollow portion and pivoted to the latch at one end, with the first and the second linkages arranged in the form of V.

5. The external module as claimed in claim 2, wherein the connector assembly comprises a connector and a spring, the spring disposed between the latch and the connector.

6. The external module as claimed in claim 1, wherein the main body comprises a second opening, into which the latch protrudes when the connector assembly is rotated to a second angle with respect to the main body.

7. A portable electronic device, comprising:

a host with a port and a fixing member;

an external module detachably connected to the host and comprising:

a main body comprising a first opening;

a connector assembly, selectively connected to the main body, wherein the main body is relatively rotatable to the connector assembly, comprising a latch, wherein the first opening provides the latch to protrude therein when the connector assembly is rotated to a first angle with respect to the main body; and a connection pin rotatably connected to the main body on a first axis;

wherein the connector assembly connects to the port, and the connection pin connects to the fixing member so that the external module and the host can connect together.

8. The portable electronic device as claimed in claim 7, wherein the connector assembly further comprises:

a connector housing rotatably connected to the external module on the first axis and having a hollow portion with the latch therein and an opening through which the latch passes; and a sliding rod movably disposed in the hollow portion.

9. The portable electronic device as claimed in claim 8, wherein the connector assembly further comprises a link mechanism connected to the latch and the sliding rod, when the main body being connected to the host, the sliding rod being pushed inward into the connector housing, so that the latch releasing from the first opening by movement of the link mechanism.

10. The portable electronic device as claimed in claim 9, wherein the link mechanism comprises:

a first linkage disposed in the hollow portion and pivoted to the latch at one end; and a second linkage disposed in the hollow portion and pivoted to the latch at one end, with the first and the second linkages arranged in the form of V.

11. The portable electronic device as claimed in claim 8, wherein the connector assembly comprises a connector and a spring, the spring disposed between the latch and the connector.

12. The portable electronic device as claimed in claim 7, wherein the external module comprises a second opening, into which the latch protrudes when the connector assembly is rotated to a second angle with respect to the main body.

13. An external module for connecting a host, comprising:

a main body with a first opening;

a connector assembly, selectively connected to the main body, wherein the main body is relatively rotatable to the connector assembly, comprising:

a connector housing;

a latch movably disposed in the connector housing;

a first sliding rod movably disposed in the connector housing;

a first linkage connecting the latch and the first sliding rod; and a spring having a first end and a second end, the first end connecting in the connector housing and the second end connecting to the first linkage, the first sliding rod, or the latch;

wherein when the main body is separated from the host, the spring forces the latch to reach out of the connector housing, so that the latch engages with the first opening; and wherein when the main body is connected to the host, the first sliding rod is against the host, the first sliding rod deforming the spring to separate the latch from the first opening.

14. The external module as claimed in claim 13, wherein the main body comprises a second opening, into which the latch protrudes when the connector assembly is rotated to a second angle with respect to the main body.

15. The external module as claimed in claim 13, wherein the connector assembly further comprises a second sliding rod and a second linkage both movably disposed in the connector housing, the second linkage connects the latch and the second sliding rod, the first and the second sliding rods protrude on each side of the connector assembly, and the first and second linkages are arranged in the form of V.

16. A portable electronic device, comprising:

a host;

an external module detachably connected to the host, comprising:

a main body, comprising a first opening;

a connector assembly, selectively connected to the main body, wherein the main body is relatively rotatable to the connector assembly, comprising:

a connector housing;

a latch movably disposed in the connector housing;

a first sliding rod movably disposed in the connector housing;

a first linkage connecting the latch and the first sliding rod; and a spring comprising a first end and a second end, the first end connecting in the connector housing and the second end connecting to the first linkage, the first sliding rod, or the latch;

wherein when the main body is separated from the host, the spring forces the latch to reach out of the connector housing, so that the latch engages with the first opening; and wherein when the main body is connected to the host, the first sliding rod is against the host, the first sliding rod deforming the spring to separate the latch from the first opening.

17. The portable electronic device as claimed in claim 16, wherein the main body comprises a second opening, into which the latch protrudes when the connector assembly is rotated to a second angle with respect to the main body.

18. The portable electronic device as claimed in claim 16, wherein the connector assembly further comprises a second sliding rod and a second linkage both movably disposed in the connector housing, the second linkage connects the latch and the second sliding rod, the first and second sliding rods protrude on each side of the connector assembly, and the first and second linkages are arranged in the form of V.

* * * * *